US007121168B2

(12) United States Patent
Shu

(10) Patent No.: US 7,121,168 B2
(45) Date of Patent: Oct. 17, 2006

(54) BIT-DRIVING APPARATUS

(76) Inventor: Zu-Shung Shu, No. 11, Alley 11, Lane 25, Kuo Chung 1st Road, Ta Li City (TW)

( * ) Notice: Subject to any disclaimer, the term of this patent is extended or adjusted under 35 U.S.C. 154(b) by 174 days.

(21) Appl. No.: 10/809,029

(22) Filed: Mar. 25, 2004

(65) Prior Publication Data

US 2005/0211027 A1 Sep. 29, 2005

(51) Int. Cl.
*B25B 13/46* (2006.01)

(52) U.S. Cl. ..... 81/60; 81/58.4

(58) Field of Classification Search ..... 81/60, 81/61–63.2, 436, 437, 58.4, 438
See application file for complete search history.

(56) References Cited

U.S. PATENT DOCUMENTS 6,349,619 B1 * 2/2002 Liao ..... 81/62
6,393,949 B1 * 5/2002 Ho ..... 81/62
6,450,067 B1 * 9/2002 Liao ..... 81/62
6,622,597 B1 * 9/2003 Chen ..... 81/438
6,976,409 B1 * 12/2005 Shu ..... 81/62
7,066,054 B1 * 6/2006 Liu ..... 81/58.4
2002/0170392 A1 * 11/2002 Chen ..... 81/58.3

* cited by examiner

*Primary Examiner*—Hadi Shakeri
(74) *Attorney, Agent, or Firm*—Alan D. Kamrath; Nikolai & Mersereau, P..A.

(57) ABSTRACT

A bit-driving apparatus is provided between a handle and a bit. The bit-driving apparatus includes a hollow shaft and a bit receiver. The hollow shaft includes a first section for connection with the handle and a second section. The bit receiver includes a first space for receiving the second section of the hollow shaft and a second space for receiving the bit. The hollow shaft drives the bit receiver through a driver. At least one connector connects the internal wall of the first space of the bit receiver with the periphery of the second section of the hollow shaft.

20 Claims, 8 Drawing Sheets

6-6

8-8

BIT-DRIVING APPARATUS

FIELD OF INVENTION

The present invention relates to a bit-driving apparatus.

BACKGROUND OF INVENTION

Referring to FIG. 10, a conventional selective one-way bit-driving apparatus 70 is provided between a handle 72 and a bit 74. The selective one-way bit-driving apparatus 70 includes a hollow shaft 76 and a bit receiver 78. The hollow shaft 76 includes a first section for connection with the handle 72 and a second section. The bit receiver 78 includes a first space for receiving the second section of the hollow shaft 76 and a second space for receiving the bit 74. The hollow shaft 76 drives the bit receiver 78 in selective one of two directions through two selective one-way drivers 80. A detent 82 is installed on the second section of the hollow shaft 76. A switch 84 in the form of a ring is provided around the first section of the hollow shaft 76. The switch 84 includes two recesses 86 in an internal face in order to receive the selective one-way drivers 88. Moreover, the switch 84 includes, in the internal face, three recesses 88, a selective one of which receives the detent 82 in order to keep the switch 84 in a selective one of three positions on the second section of the hollow shaft 76. A bolt 90 is driven into a central hole in the bit receiver 78 through a tunnel of the hollow shaft 76 so as to connect the hollow shaft 76 with the bit receiver 78. The bolt 90 is inadequate in holding the hollow shaft 76 to the bit receiver 78. The bolt 90 may be twisted and broken so as to leave a portion of the bolt 90 in the central hole of the bit receiver 78 that renders the bit receiver 78 useless. The first space of the bit receiver 78 is isolated from the tunnel of the hollow shaft 76 so that the selective one-way bit-driving apparatus 70 cannot be used with a bit 74 with two operative ends since that bit 74 requires a long tunnel.

The present invention is therefore intended to obviate or at least alleviate the problems encountered in the prior art.

SUMMARY OF INVENTION

It is an objective of the present invention to provide a selective one way bit-driving apparatus that can be assembled and dismantled easily for maintenance and replacement of parts.

It is another objective of the present invention to provide a selective one way bit-driving apparatus that is useful for receiving a bit with two operative ends.

According to the present invention, a selective bit-driving apparatus is provided between a handle and a bit. The bit-driving apparatus includes a hollow shaft and a bit receiver. The hollow shaft includes a first section for connection with the handle and a second section. The bit receiver includes a first space for receiving the second section of the hollow shaft and a second space for receiving the bit. The hollow shaft drives the bit receiver through a driver. At least one connector connects the wall of the first space of the bit receiver with the periphery of the second section of the hollow shaft.

Other objectives, advantages and novel features of the invention will become more apparent from the following detailed description in conjunction with the attached drawings.

BRIEF DESCRIPTION OF THE DRAWINGS

The present invention will be described via detailed illustration of two embodiments referring to the drawings.

DETAILED DESCRIPTION OF EMBODIMENTS

Figure 1:
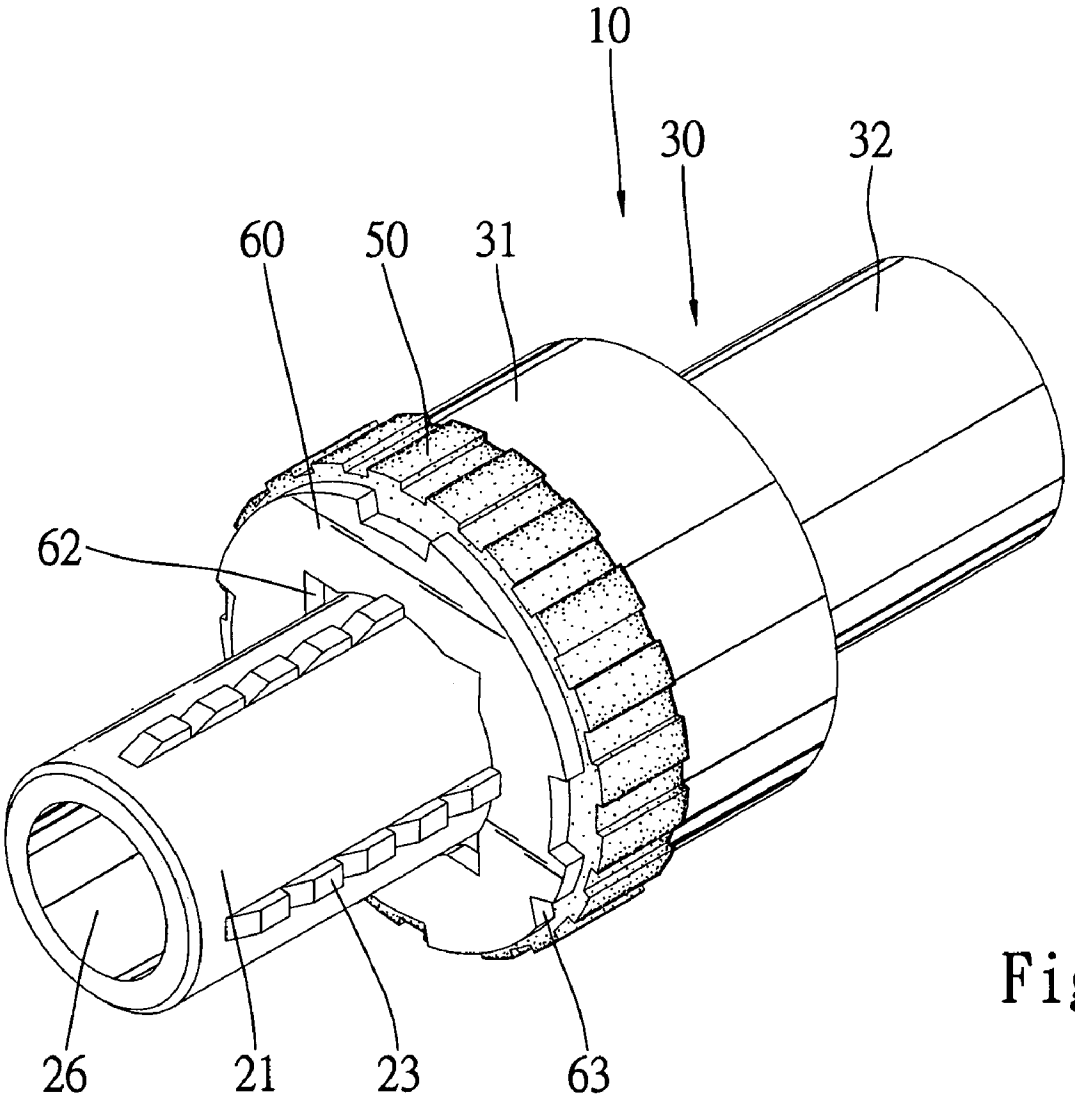
FIG. 1 is a perspective view of a bit-driving apparatus according to a first embodiment of the present invention.

Referring to FIG. 1, according to a first embodiment of the present invention, a bit-driving apparatus 10 is provided to encompass a bit with two operative ends.

Figure 2:
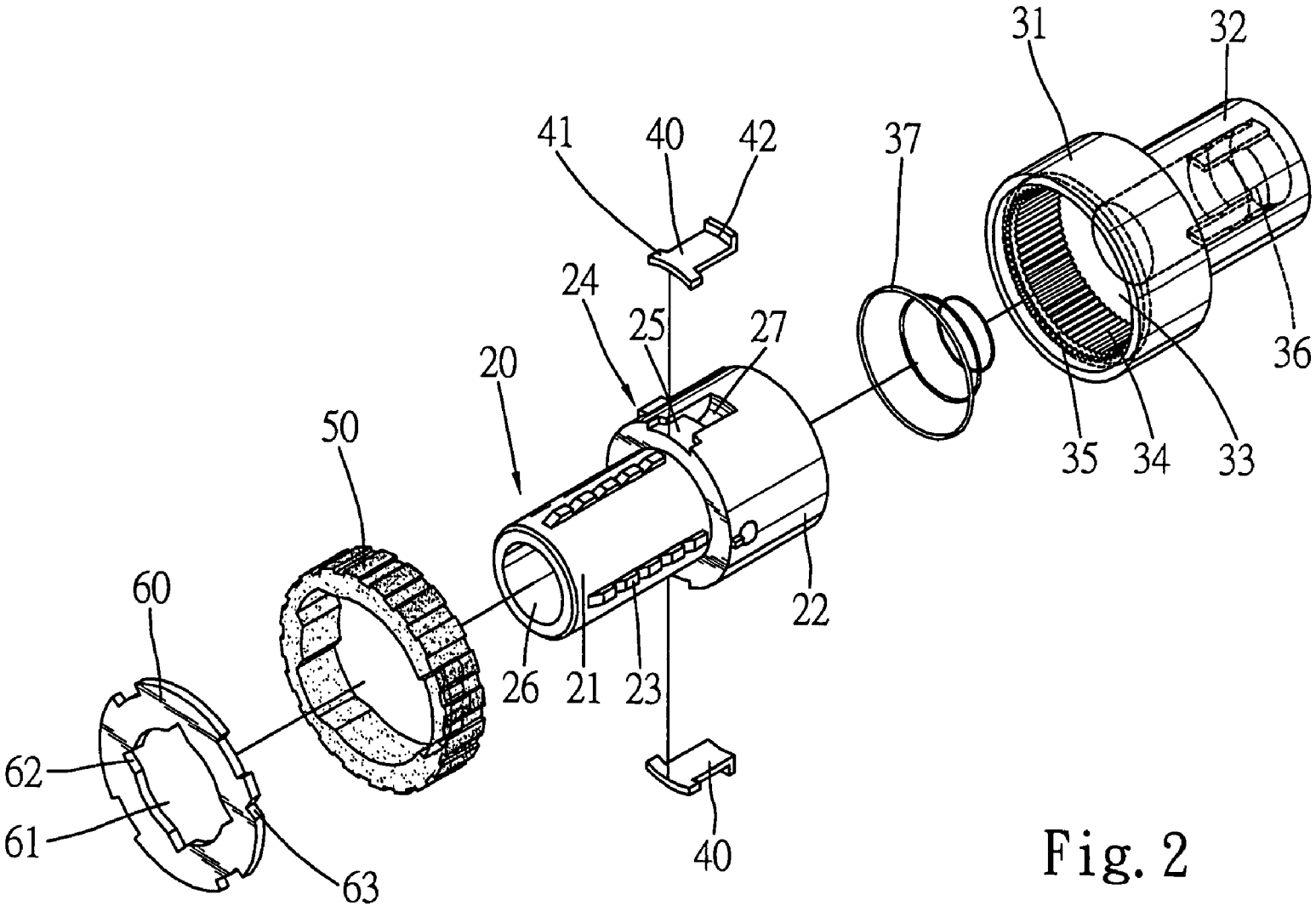
FIG. 2 is an exploded view of the bit-driving apparatus shown in FIG. 1.

Referring to FIG. 2, the bit-driving apparatus 10 includes a hollow shaft 20 for connection with a handle (not shown) and a bit receiver 30 for receiving a bit (not shown). Apparatus 10 further includes a driver 24 through which the hollow shaft 20 drives the bit receiver 30, with the driver 24 in the preferred form shown being of the selective one-way type for driving the bit receiver in a selective one of two directions. Apparatus 10 also includes two connectors 40 for connecting the bit receiver 30 with the hollow shaft 20, a restraint 50 for restraining the connectors 40 and a lock 60 for locking the restraint 50 to the hollow shaft 20.

The hollow shaft 20 includes a first section 21 and a second section 22 with an external diameter greater than that of the first section 21. Four rows of teeth and preferably ratchets 23 are formed on the first section 21. As the first section 21 is put in the handle, the teeth 23 hold the first section 21 to the handle. Moreover, the teeth 23 cooperate with the lock 60 in a manner to be described. Two T-shaped cavities 25 and two cavities 27 are defined in the second section 22 so that each T-shaped cavity 25 is communicated with a related cavity 27. The cavities 27 are deeper than the T-shaped cavities 25 for a reason to be described. As a hollow element, the hollow shaft 20 defines an axial tunnel 26.

The bit receiver 30 includes a first section 31 and a second section 32. The first section 31 defines a space 33. The second section 32 defines a space 36 communicated with the space 33. Teeth 34 are formed on an internal face of the first section 31. An annular groove 35 is defined in the internal face of the first section 31. A spring 37 is provided in the space 33.

The driver 24 is installed on the second section 22. As the second section 22 of the hollow shaft 20 is put in the first section 31 of the bit receiver 30, the driver 24 is engaged with the teeth 34.

Figure 4:
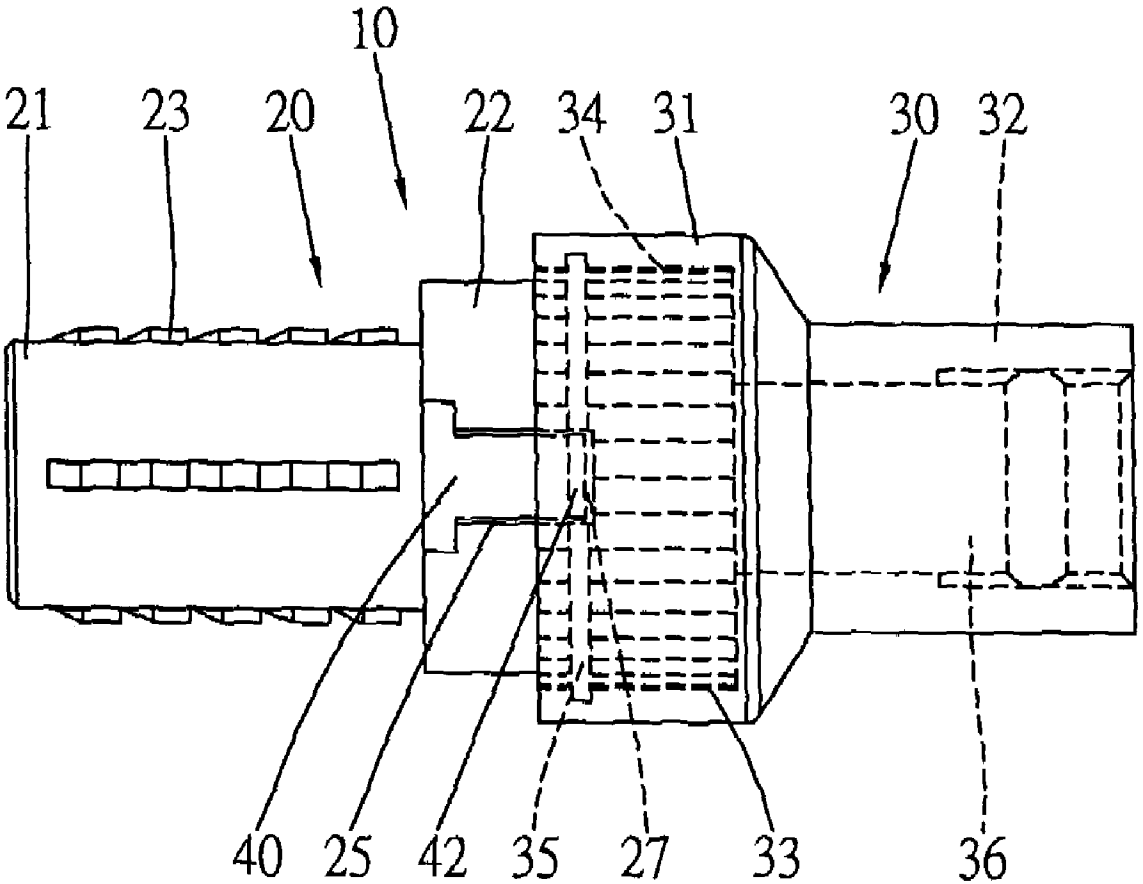
FIG. 4 is a top view of the portion of the bit-driving apparatus of FIG. 3

Each connector 40 includes a body, a T-shaped head 41 extending from the body in a same plane and a bent tail 42 projecting from the body in a perpendicular plane. Referring to FIG. 4, the T-shaped head 41 of each connector 40 is put in a related T-shaped cavity 25 so that the bent tail 42 is put in a related cavity 27.

Figure 3:
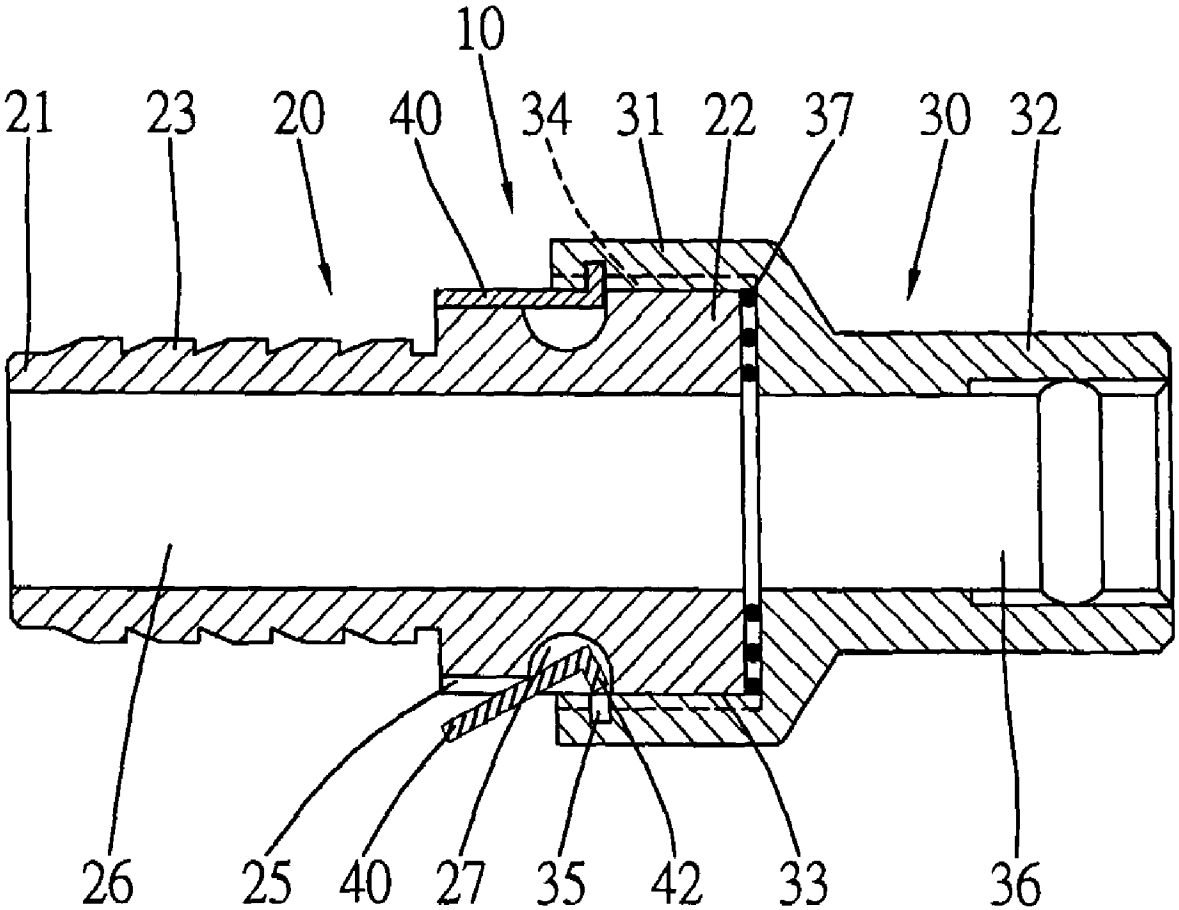
FIG. 3 is a cross-sectional view of a portion of the bit-driving apparatus shown in FIG. 1.

Referring to FIG. 3, the bent tail 42 of one connector 40 is put deep in a related cavity 27 so that it is outside the annular groove 35 and that the T-shaped head 41 is outside a related T-shaped cavity 25. The bent tail 42 of the other connector 40 is put in the annular groove 35 so that the T-shaped head 41 is in a related T-shaped cavity 27.

When the bent tail 42 of each connector 40 is outside the annular groove 35 and the T-shaped head 41 is outside a related T-shaped cavity 25, the second section 22 of the hollow shaft 20 can be moved from the first section 31 of the bit receiver 30. On the contrary, when the bent tail 42 of each connector 40 is in the annular groove 35 and the T-shaped head 41 is in a related T-shaped cavity 25, the second section 22 of the hollow shaft 20 is locked to the first section 31 of the bit receiver 30.

Referring to FIG. 2, the restraint 50 is in the form of a ring that can be put around the second section 22 of the hollow shaft 20. The lock 60 is in the form of a washer, i.e., it defines a central hole 61 for receiving the first section 21 of the hollow shaft 20. Moreover, the lock 60 defines four recesses 62 for receiving the rows of the teeth 23. The lock 60 includes a mark 63 for indication of the direction in which the lock 60 should be rotated in order to lock.

Figure 6:
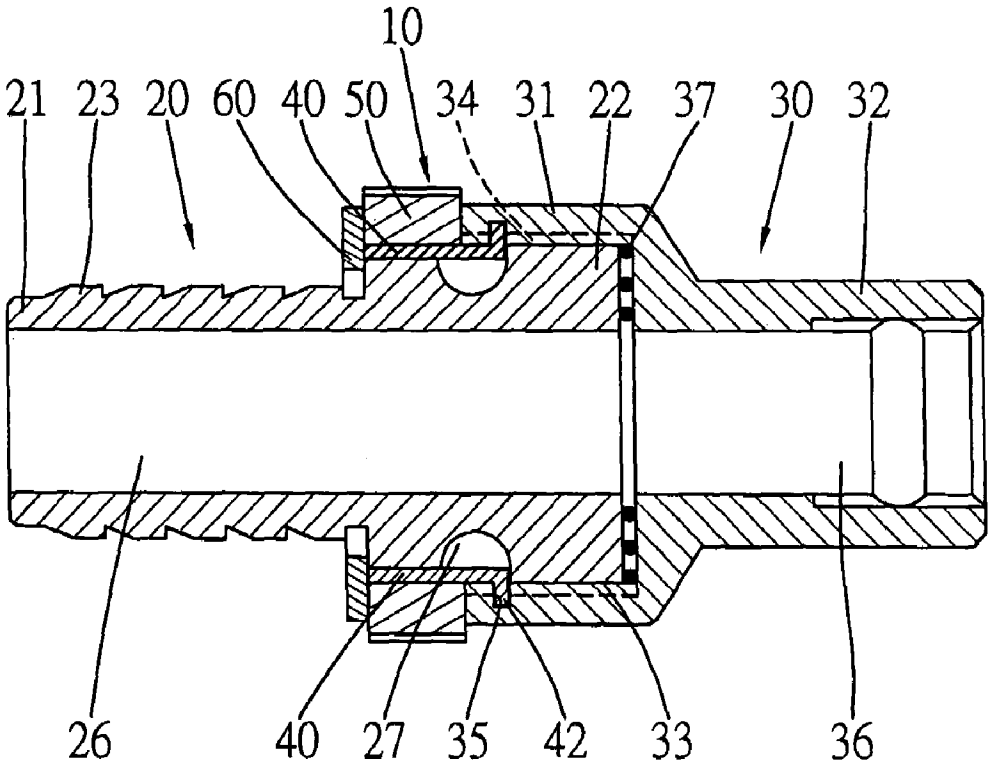
FIG. 6 is a cross-sectional view of the bit-driving apparatus taken along a line 6—6 in FIG. 1.
Figure 5:
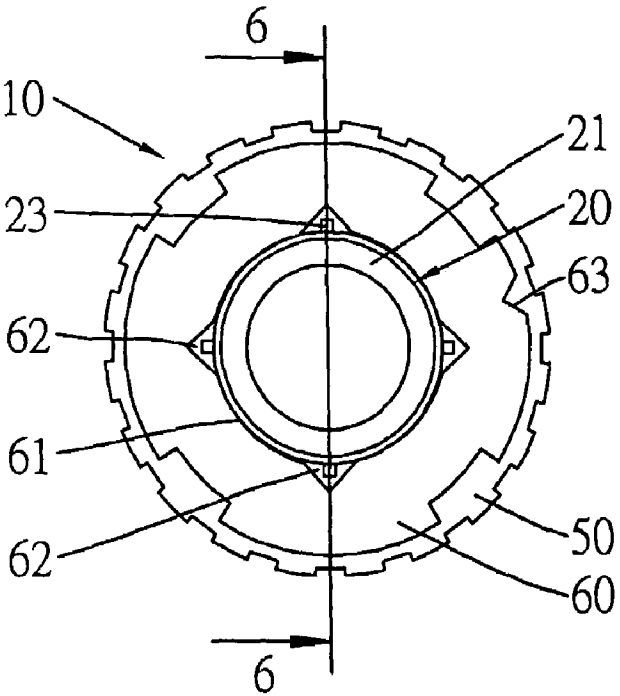
FIG. 5 is a left side view of the bit-driving apparatus shown in FIG. 1.

Referring to FIGS. 5 and 6, the restraint 50 is put around the second section 22 of the hollow shaft 20. The T-shaped heads 41 of the connectors 40 are restrained in the T-shaped cavities 25 by the restraint 50. The bent tails 42 of the connectors 40 are restrained in the cavities 27 accordingly. The central hole 61 of the lock 60 is aligned with the first section 21 of the hollow shaft 20 and the recesses 62 are aligned with the rows of teeth 23 so that the lock 60 can be put around the first section 21 of the hollow shaft 20.

Figure 8:
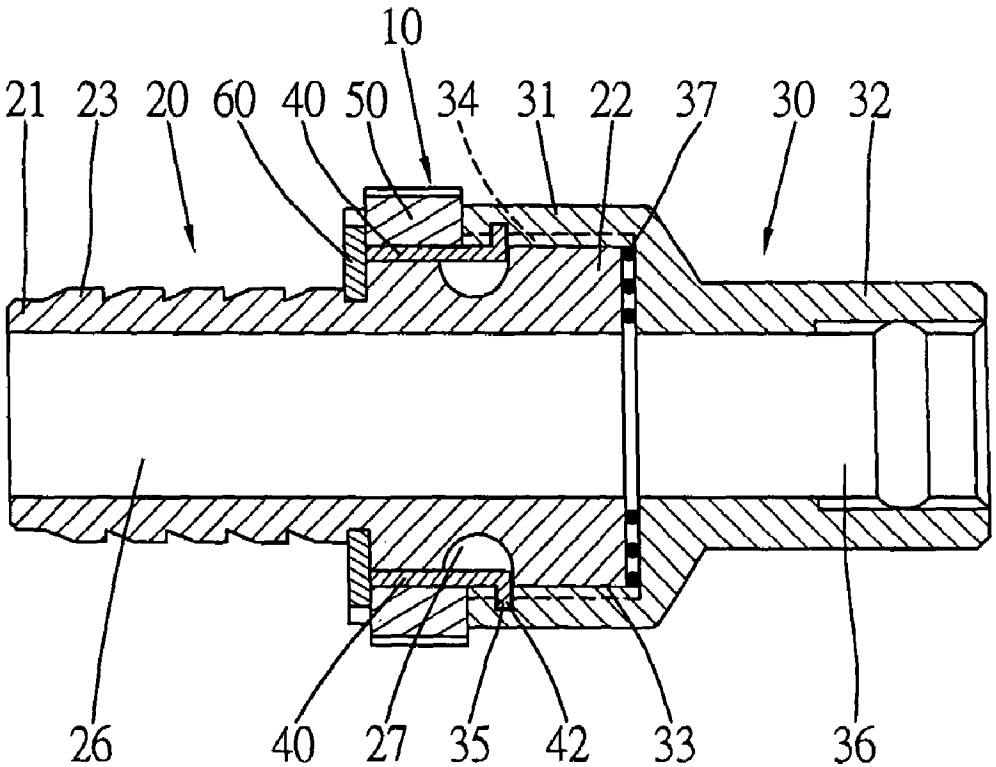
FIG. 8 is a cross-sectional view of the bit-driving apparatus taken along a line 8—8 in FIG. 7.
Figure 7:
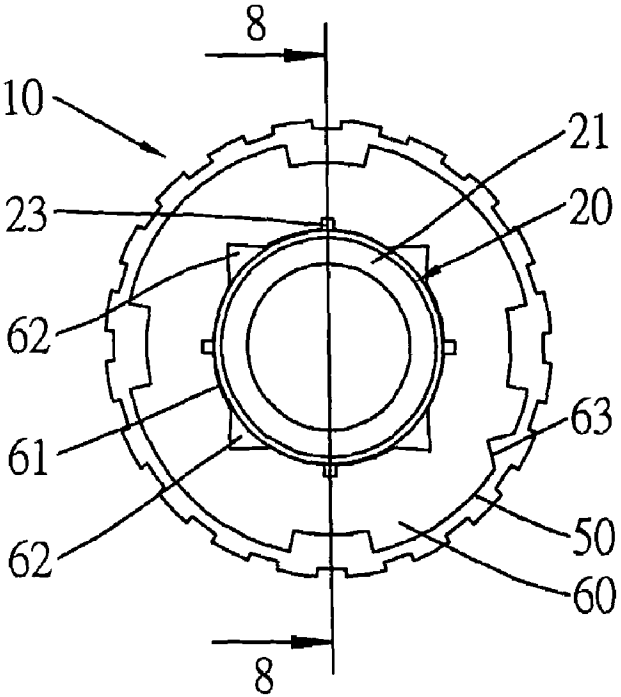
FIG. 7 is similar to FIG. 5 but shows the bit-driving apparatus in a different position.

Referring to FIGS. 7 and 8, the lock 60 is rotated so that the recesses 62 are not aligned with the rows of teeth 23 so that the lock 60 is restrained around the first section 21 of the hollow shaft 20 by the rows of teeth 23.

Figure 9:
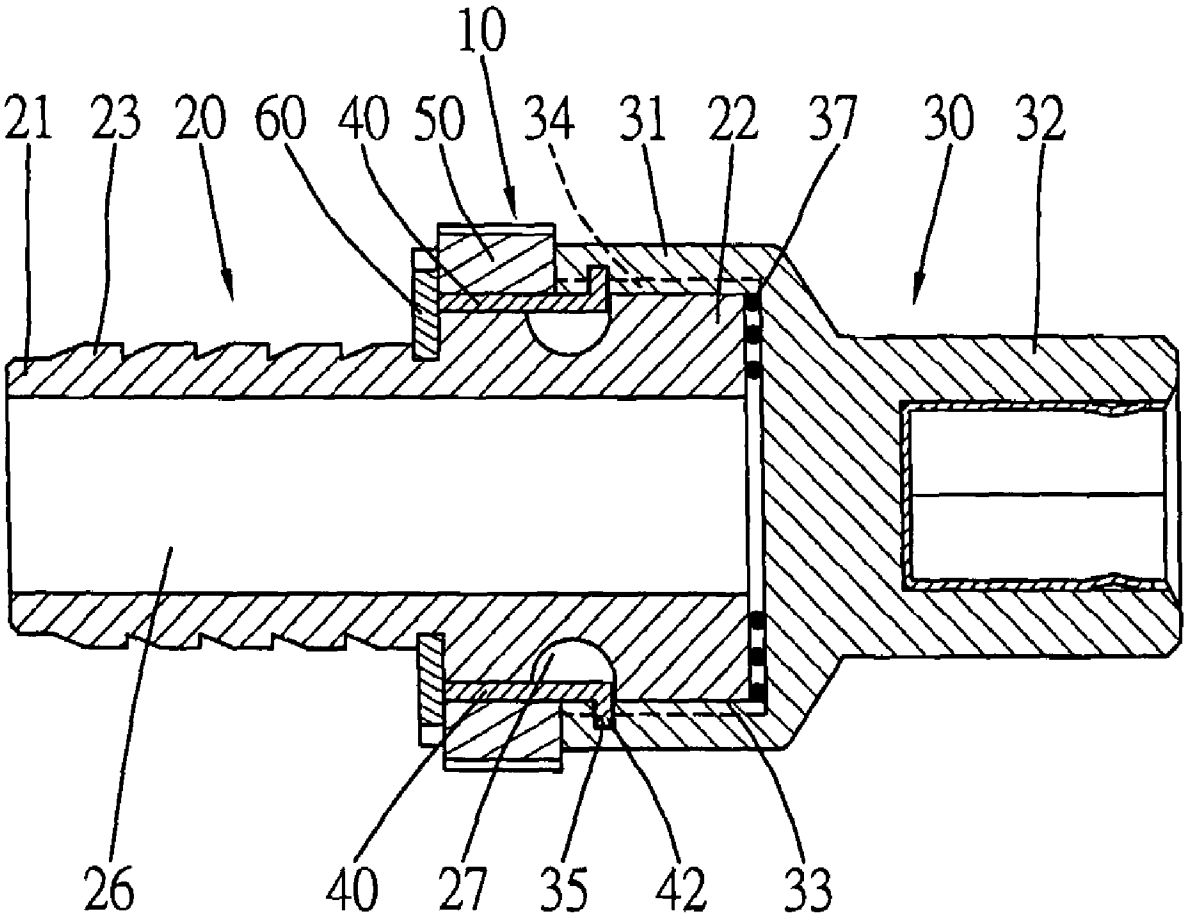
FIG. 9 is similar to FIG. 8 but shows a bit-driving apparatus according to a second embodiment of the present invention.
Figure 10:
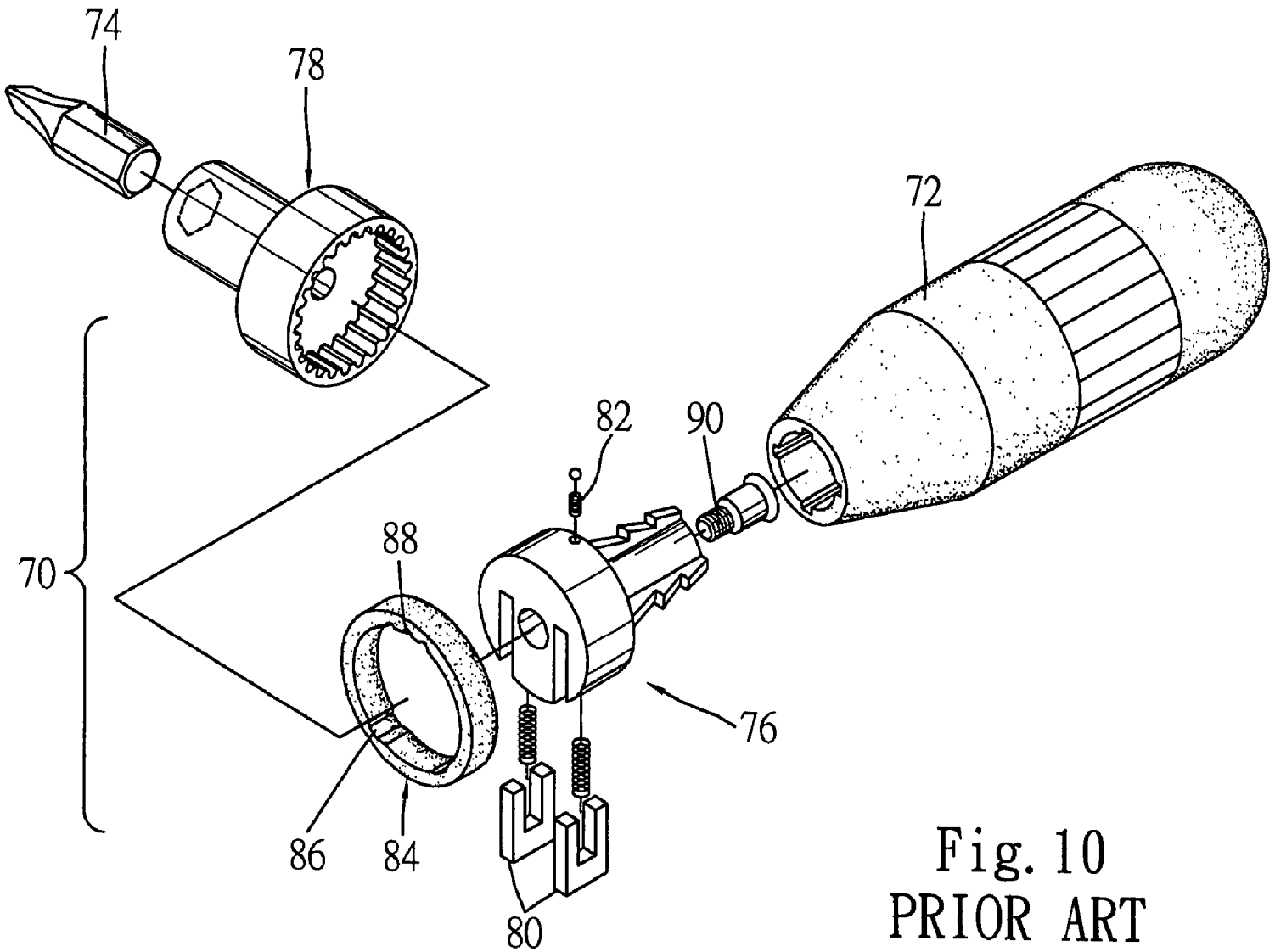
Fig. 10 PRIOR ART
FIG. 10 is an exploded view of a conventional selective one-way bit-driving apparatus.

FIG. 9 shows a bit-driving apparatus 10 according to a second embodiment of the present invention. The second embodiment is identical to the first embodiment except that the space 33 of the bit receiver 30 is not communicated with the space 36. Thus, as the second section 22 of the hollow shaft 20 is put in the first section 31 of the bit receiver 30, the axial tunnel 26 of the hollow shaft 20 is not communicated with the space 36 of the bit receiver 30.

Both the first and second embodiments of the present invention can be assembled and dismantled easily for maintenance and replacement of parts. The first embodiment is useful for receiving the bit with two operative ends due to the axial tunnel 26 of the hollow shaft 20 communicated with the space 36 of the bit receiver 30.

The present invention has been described via detailed illustration of the embodiments. Those skilled in the art can derive variations from the embodiments without departing from the scope of the present invention. Therefore, the embodiments shall not limit the scope of the present invention that is defined in the claims.

The invention claimed is:

1. A bit-driving apparatus including a hollow shaft including a first section for connection with a handle and a second section including a periphery, a bit receiver including a first space having an internal wall for receiving the periphery of the second section of the hollow shaft and a second space for receiving a bit, a driver carried on the periphery of the hollow shaft to drive the bit receiver, at least one connector for connecting the internal wall of the first space of the bit receiver with the periphery of the second section of the hollow shaft, a restraint located outwardly of the bit receiver for restraining the connector relative to the internal wall of the first space of the bit receiver and the periphery of the second section of the hollow shaft, and a lock for locking the restraint.

2. The bit-driving apparatus according to claim 1 including two connectors.

3. The bit driving apparatus according to claim 2 with the internal wall of the first space of the bit receiver including teeth engaged by the driver.

4. The bit-driving apparatus according to claim 1 wherein the first section of the hollow shaft includes at least two series of teeth on a periphery for holding onto an internal face of the handle.

5. The bit-driving apparatus according to claim 1 including a spring provided in the first space of the bit receiver for biasing the hollow shaft.

6. The bit-driving apparatus according to claim 1 wherein the first space is communicated with the second space of the bit receiver.

7. The bit-driving apparatus according to claim 1 wherein the first space is isolated from the second space of the.

8. The bit driving apparatus according to claim 1 wherein the restraint is in the form of a ring put around the periphery of the second section of the hollow shaft.

9. The bit driving apparatus according to claim 8 wherein the lock is in the form of a washer rotatably received on the first section of the hollow shaft.

10. The bit-driving apparatus according to claim 9 wherein the lock defines a central hole for receiving the first section of the hollow shaft.

11. A bit-driving apparatus including a hollow shaft including a first section for connection with a handle and a second section including a periphery, a bit receiver including a first space having an internal wall for receiving the periphery of the second section of the hollow shaft and a second space for receiving a bit, a driver carried on the periphery of the hollow shaft to drive the bit receiver, and at least one connector for connecting the internal wall of the first space of the bit receiver with the periphery of the second section of the hollow shaft, wherein the connector includes a T-shaped head and a bent tail, wherein the second section of the hollow shaft includes at least one T-shaped cavity in the periphery in order to receive the T-shaped head of the connector, wherein the bit receiver includes an annular groove in the internal wall of the first space in order to receive the bent tail of the connector.

12. The bit-driving apparatus according to claim 11 wherein the second section of the hollow shaft includes at least one deep cavity into which the connector can be pivoted so that the T-shaped head connector can be pivoted from the T-shaped cavity.

13. The bit-driving apparatus according to claim 12 including a restraint for restraining the connector.

14. The bit-driving apparatus according to claim 13 wherein the restraint is in the form of a ring.

15. The bit-driving apparatus according to claim 13 including a lock for locking the restraint.

16. The bit-driving apparatus according to claim 15 wherein the lock is in the form of a washer.

17. The bit-driving apparatus according to claim 16 wherein the lock defines a central hole for receiving the first section of the hollow shaft.

18. The bit-driving apparatus according to claim 17 wherein the lock defines at least two recesses, wherein the first section of the hollow shaft includes at least two teeth on a periphery so that the lock can be moved to the restraint past the teeth when the recesses are aligned with the teeth and that the lock is kept against the restraint by the teeth when the recesses are not aligned with the teeth.

19. The bit-driving apparatus according to claim 18 wherein the lock defines four recesses, wherein the first section of the hollow shaft includes four teeth.

20. The bit-driving apparatus according to claim 18 wherein the lock includes a mark for indication of the direction in which the lock should be rotated in order to lock.

* * * * *